US007332988B2

(12) United States Patent
Baleras et al.

(10) Patent No.: US 7,332,988 B2
(45) Date of Patent: Feb. 19, 2008

(54) FREQUENCY FILTER AND ITS MANUFACTURING PROCESS

(75) Inventors: Francois Baleras, Seyssinet (FR); Pierre Blondy, Limoges (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 11/156,553

(22) Filed: Jun. 21, 2005

(65) Prior Publication Data

US 2006/0125579 A1 Jun. 15, 2006

(30) Foreign Application Priority Data

Jun. 22, 2004 (FR) ..... 04 51309

(51) Int. Cl.
*H01P 1/20* (2006.01)
*H01P 1/219* (2006.01)

(52) U.S. Cl. ..... 333/202; 333/208; 333/210

(58) Field of Classification Search ..... 333/202, 333/208, 210; 29/600
See application file for complete search history.

(56) References Cited

U.S. PATENT DOCUMENTS 4,675,631 A * 6/1987 Waggett ..... 333/210
6,597,260 B2 * 7/2003 Sasaki et al. ..... 333/134

* cited by examiner

*Primary Examiner*—Seungsook Ham
(74) *Attorney, Agent, or Firm*—Oblon, Spivak, McClelland, Maier & Neustadt, P.C.

(57) ABSTRACT

The invention relates to a frequency filter including a structure with, on one face, two extreme evanescent areas and at least one wave guide area between the evanescent areas. The at least one wave guide area and the evanescent areas form a single closed cavity. The single cavity is partitioned by at least two resonator elements that are embedded in the single cavity at placement areas and that contribute to delimiting the at least one wave guide area and the evanescent areas.

24 Claims, 7 Drawing Sheets

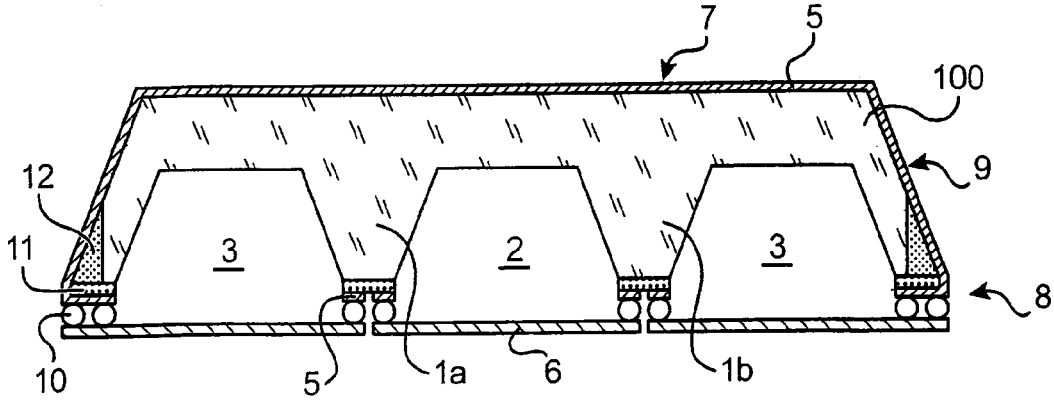
FIG. 1 PRIOR ART
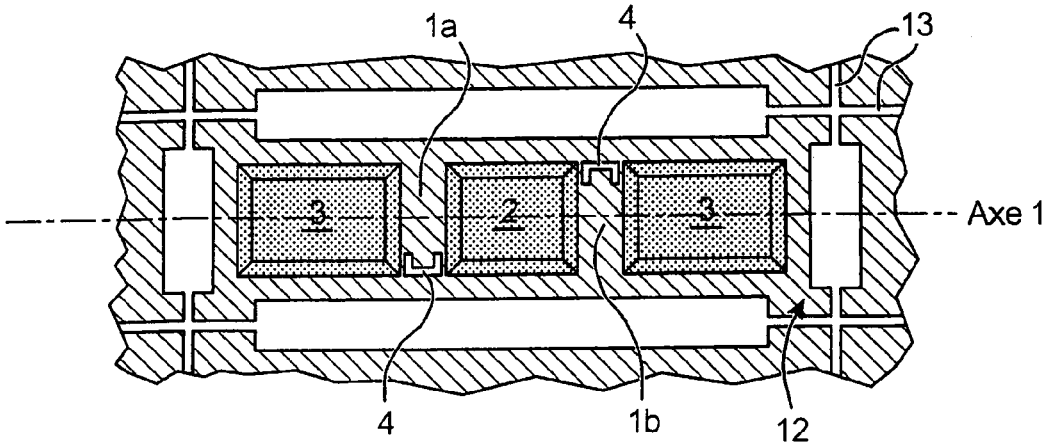
FIG. 2 PRIOR ART
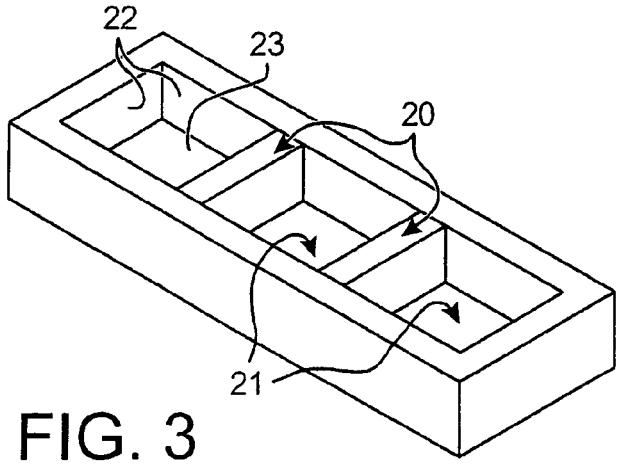
FIG. 3

FREQUENCY FILTER AND ITS MANUFACTURING PROCESS

TECHNICAL FIELD

This invention relates to a frequency filter and its manufacturing process.

BACKGROUND OF THE INVENTION

Frequency filters are elements capable of allowing passage of a determined frequency range of an alternating type signal, for example an electromagnetic wave or an acoustic wave.

Frequency filters are particularly used in elements intended for high frequency applications. For example, they are found in multiplexers, diplexers, amplifiers, oscillators or mixers.

High frequencies are useful because they can carry a large amount of information. Furthermore, the increase in frequency can significantly improve the resolution of detection devices and can miniaturise systems. Thus, there are many high frequency applications; for example they are used in broadband radio communications and inter-satellite radio communications (frequency about 60 GHz), in anti-collision radars (frequency 70 GHz) and radiometry (frequency 180 GHz).

The document "Integrated millimetre-wave silicon micromachined filters", written by the IRCOM, the CEA and the CNES, in October 2000 presents an embodiment of micromachined filters for high frequency applications.

FIGS. 1 and 2 represent 2-pole filters or resonators made using the technique described in this document. These filters comprise a structure (substrate 100) that can be decomposed into several areas:

- at least two areas 1*a*, 1*b* acting as dielectric resonators,
- at least one wave propagation area 2 located between two resonators and acting as a wave guide,
- two extreme areas 3 forming evanescent areas.

The dielectric resonators 1*a*, 1*b* are made from dielectric materials with a high relative permittivity. This high permittivity confines electric fields in the resonator. Resonator sizes must be chosen to fix the required operating frequency of the filter, as is known to those skilled in the art.

The cavity-shaped propagation area 2 forms a wave guide that couples the two resonators 1*a* and 1*b*. The guide dimensions act on the coupling factor and on the frequency of the filter obtained.

Finally, the two extreme cavity-shaped areas form two evanescent areas that have the function of eliminating reflections of parasite waves. To be efficient, these evanescent areas must be longer than the waves circulating in the filter.

At the present time, frequency filters are made by successive deposition and etching steps. The disadvantage of this operating method is that it limits the possibilities of making filters and also restricts their performances.

The filter illustrated in FIG. 1 is composed of a structure comprising three cavities and arranged on a metallisation layer 6. In general, the filter structures are micro-machined in a high resistivity silicon substrate 100, because this is a material with low dielectric losses at millimetric wavelengths and a high permittivity, which makes it possible to make miniaturised filters.

Once the filter structure is terminated, it is covered with an electromagnetic shielding. This shielding avoids the dispersion of waves in the filter or accidental escape of the waves. The shielding consists of three metallisations: a metallisation 5 on the front face 7 of the structure, a metallisation 5 on the back face 8 of the structure, and a metallisation 6 on which the structure of the filter will be placed. This metallisation 6 is often a metallisation layer deposited on a host substrate. The different metallisations are connected together to close the shielding around the filter to make the contact between the front face 7 and the back face 8 of the filter structure by metallisation of four edges 9 or sides that surround the structure, and by making the contact between the back face 8 and the host substrate, on which the metallisation layer 6 is placed, through a fusible alloy 10 (fusible balls). The filter is transferred using fusible balls 10 onto a host substrate using the flip-chip or an equivalent method. The micro-machined filters installed in flip-chip have the advantage that they can then be integrated into more complex subassemblies.

FIG. 2 shows that the filter structure comprises at least two coupling windows 4 that couple resonators with the metallic tracks 6 of the host substrate.

There are many disadvantages related to micro-machined filters like those described in prior art, related to their manufacturing method and their performances.

As has already been seen, several areas of the silicon substrate 100 must be etched to make a frequency filter. The cavities that will form the wave guide and the evanescent areas that surround the resonators, and the four edges that surround the filter structure and enable contact of the shielding between the front face and the back face of the filter structure, have to be etched. The surface hollowed out from the remaining surface of the substrate makes the substrates fragile when the filters are being made. The number of structures made on each substrate wafer has to be reduced, to prevent substrate wafers from breaking.

The filters are held in place during manufacturing by support beams 12 in the substrate. These support beams are preferably placed at the corners of the filter (see FIG. 2) to minimise parasite effects related to breakage of the shielding at these areas. When these beams are cut out, the shielding on these beams must be cut to release the filters, and it reduces the performances of the filter.

Furthermore, etching is usually done by wet etching to make a micro-machined filter. Since the internal cavities of the filter, in other words the wave guide(s) and the two evanescent areas, do not necessarily have the same dimensions, the cavities cannot be made by plasma etching. Plasma etching is specific in that it has an etching rate that depends on the surface of the pattern; therefore, it is impossible to have the same etching depth for two different pattern sizes. Wet etching of silicon is an anisotropic etching that follows the <111> crystalline plane of silicon at an angle of 54.7° from the <100> crystalline plane. An alignment error of 10 causes a loss of dimension of 175 μm for a structure length of 1 cm. Thus, the dimensions of the patterns to be etched and the precision of the searched alignments make it impossible to reproduce the filters. Since the resonant frequency and the quality factor of a filter depend on the dimensions of its cavities and its resonators, the performances of filters vary from one filter to another.

Furthermore, as can be seen in FIG. 1, a layer of dielectric material 11 is deposited between the silicon 100 from which the filter structure is made and the metallisation layer 5, to isolate the substrate from the metallisation layer. Note that this layer of dielectric material 11 should ideally be present under the entire metallisation layer 5 to provide the best performances. However, for reasons of simplification of the technology, it is only provided at the connection with the host substrate. For hyperfrequency applications, it is desirable to use dielectric materials with low dielectric losses. For example, $SiO_2$ deposited by PECVD will be chosen, which generally has lower dielectric losses than thermal $SiO_2$. These dielectric materials must also be only slightly stressed to prevent a large deformation (sag) of the filter structure that would prevent the operation to assemble it with the host substrate. For example, assembly is not possible if the deformation of the structure is greater than the difference in height of the fusible balls. Furthermore, this dielectric material must be used as a mask during etching of the substrate. Dielectric materials that are interesting for hyperfrequency applications are not necessarily adapted to wet etching of silicon. Thus, there is a very small choice of dielectric materials.

PRESENTATION OF THE INVENTION

The purpose of the invention is to provide a filter and a process for manufacturing micro-machined filters for hyperfrequency applications that do not have the disadvantages of prior art.

This and other purposes are achieved according to the invention by a frequency filter comprising a structure with, on one face, two extreme evanescent areas and at least one wave guide area between the evanescent areas, characterised in that the at least one wave guide area and the evanescent areas form a single closed cavity, the said single cavity being partitioned by at least two resonator elements that are embedded in the said single cavity at placement areas and that contribute to delimiting the said at least one wave guide area and the evanescent areas.

A placement area is a portion of the single cavity in which a given resonator element must be embedded and encased.

Advantageously, the single cavity has at least one wall and/or one bottom that has at least one protuberant part and at least one setback part, the said parts forming a relief that helps with embedding the resonator elements in the single cavity at their placement area.

Advantageously, the structure is made from a material with low dielectric losses.

Advantageously, the resonator elements are made from a material with a high permittivity and low dielectric losses.

"Low dielectric losses" means losses with tangent loss values equal to about $8.6\times10^{-4}$ at 40 GHz and "high permittivity" means a permittivity typically more than 10 for a frequency of 40 GHz.

Advantageously, the resonator elements are made from silicon or ceramic.

Advantageously, at least two resonator elements will be made from an identical material and have identical dimensions. If there are more than two resonator elements, the others may have different dimensions (these dimensions will be chosen as a function of the bandwidth required for the filter).

The frequency filter according to the invention is characterised in that it comprises an electromagnetic shielding, the said shielding comprising:

- a first metallisation layer covering the bottom and the walls of the single cavity and the face of the structure containing the single cavity,
- a second metallisation layer closing the single cavity and being in electrical contact with the first metallisation layer and with the resonator elements. The first and second metallisation layers form the shielding of the filter.

Advantageously, the second metallisation layer is deposited on a host substrate with low dielectric losses.

Advantageously, the shielding comprises at least two openings, called coupling windows. Advantageously, these openings are made at the resonator elements. These coupling windows are slits made in the metallisations to enable the electromagnetic field to pass through the filter.

The invention also relates to a process for making at least one frequency filter like that described above. This manufacturing process comprises the following steps:

- manufacture of a structure comprising at least one cavity on one of its faces, called the back face,
- embedment of at least two resonator elements in the cavity at placement areas so as to delimit the at least one wave guide area and the evanescent areas.

Advantageously, the process for manufacturing at least one frequency filter also comprises a metallisation step of the back face of the structure, the walls and the bottom of the cavity before the embedment step of the resonator elements, and a step to close the cavity using a metallisation layer after the said embedment step.

Advantageously, the metallisation layer used to close the cavity comprises at least two openings. These openings act as coupling windows.

The metallisation covers the bottom and the walls of the cavity and the back face of the structure, in other words the face comprising the cavity.

The metallisation layer used to close the cavity is in electrical contact with the first metallisation layer located partly on the back face of the structure and with the resonator elements.

Advantageously, the manufacture of the structure in the process for making a filter comprises the following steps:

- supply of a first substrate,
- etching of at least the cavity in the said first substrate.

Note that several filter structures can be made in a single substrate wafer.

This first substrate may be made from any material, in other words a semiconducting, insulating or conducting material.

Advantageously, the first substrate is made from a material with low dielectric losses.

Advantageously, the first substrate may be made from a material chosen among silicon, quartz or any other similar material. The material is chosen as a function of the technique used to make the structure. For example, a silicon substrate could be chosen if plasma etching is required.

Advantageously, plasma etching is used and is done according to the following steps:

- deposition of a layer of photosensitive resin on the back face of the first substrate,
- exposure of the photosensitive resin through a mask and development of the said resin,
- etching of the first substrate,
- elimination of the photosensitive resin,
- deposition of a layer of dielectric material on the back face of the first substrate.

Advantageously, the dielectric material is polycrystalline silicon (polysilicon), silica, an organic dielectric (for example benzo cyclobutene BCB or a polyimide) or multilayers (for example silicon oxide and polycrystalline silicon or silicon oxide and silicon nitride).

According to one variant, the first substrate is etched to a greater depth at the placement areas of the resonator elements.

Advantageously, the mask used has a pattern to obtain a cavity with at least one protuberant part and at least one setback part in at least one wall and/or the bottom of the cavity. A protuberant part means a part projecting from the setback part.

Advantageously, the manufacturing process for a filter according to the invention includes the manufacture of resonator elements comprising the following steps:

supply of a second substrate, separation of resonator elements by cutting or by etching of the said second substrate.

Advantageously, the manufacture of resonator elements also comprises a step to adjust the height of the said second substrate after the step to supply the second substrate, so as to fix the size of the resonator. Advantageously, the thickness of the resonator must be equal to the depth of the cavity at the wave guide area (in particular taking account of the thickness of the material possibly added for assembly, such as glue or solder). This height adjustment may be done by mechanical and/or chemical thinning. This adjustment may also be made by other means, for example by depositing a more or less thick metallisation layer on the resonator elements, or by etching the resonator element placement area more than the rest of the cavity.

The resonator elements are encased in the single cavity at their corresponding placement area. Once embedded in the cavity at their corresponding placement area, the resonator elements match the shape of the walls and the bottom of the single cavity. The resonator elements are the same shape as the placement areas in which they must be inserted. Depending on the shape of these placement areas, cutting of the resonators may be simple, in other words rectangular or square resonator elements are obtained, or they may be more complicated when the resonator element has setback parts and protuberant parts that will be embedded in the part of the placement area exceeding the width of the single cavity.

In general, the dimension of the resonator element is such that a single resonator element can be placed in each placement area, in other words for example it would be possible to place only one resonator element along the width of the single cavity.

Each resonator element is embedded (in other words is inserted, placed, encased, brazed, soldered or glued) in the single cavity at its corresponding placement area such that once placed, the resonator elements are separated from each other by a free space sized to guide the waves inside the filter and the resonator elements that face the walls forming a part of the extreme evanescent areas are separated from the said walls by a space greater than the wavelength of waves travelling along the wave guide.

The filters must comprise at least two coupling windows, allowing the electromagnetic field to enter and to exit from the filter. These windows are slits preferably formed at the resonators in the metallisations to allow the electromagnetic field to pass through. For example, they may be obtained by photolithography and etching of metallic shielding layers just after manufacture of the said layers. Advantageously, they may open up on the material of the resonator element; this can be done by drawing off the dielectric material located in the openings formed in the metallic layers.

According to one variant, the second substrate used in the manufacture of resonator elements is made from a material chosen from among silicon, alumina, quartz or any other similar material. A similar material means a material with a high permittivity and low dielectric losses. Using a material with a high permittivity will tend to encourage concentration of the hyperfrequency electromagnetic field in the material.

According to another variant, the manufacture of resonator elements also includes a step to deposit a layer of a dielectric material on a face of the second substrate, two opposite faces of the second substrate or four opposite faces of the second substrate.

Advantageously, the manufacture of resonator elements also includes a step to deposit a metallisation layer on the face(s) of the second substrate comprising a layer of dielectric material. This deposition step is not necessary if the cavity and the host substrate are already metallised. This step may become necessary depending on the assembly method. In this case, a special metallisation will be made. For example, this will be the case for soldering or brazing.

If the resonator elements comprise one or several metallic faces, care will be taken that the faces of the resonator elements that open up in the evanescent areas or into the area(s) of the wave guide are never metallised, since this would prevent coupling between the resonator elements.

BRIEF DESCRIPTION OF THE DRAWINGS

The invention will be better understood and other advantages and special features will become clear after reading the following description given as a non-limitative example accompanied by the attached drawings among which:

FIG. 1, already described above, represents a filter according to prior art according to a lateral sectional view (section along axis 1 shown in FIG. 2), FIG. 2, already described above, represents a bottom view of a filter according to prior art, before its assembly with a metallisation layer arranged on a host substrate. Note that in FIG. 2, it can be seen that the substrate comprises several structures, each structure being detached from its neighbours as shown by the cut-out 13, FIGS. 3 and 4 represent a simplified bottom view and a three-dimensional view respectively of two examples of unclosed filter structures according to the invention.

Note that the drawings are not to scale. The deposited layers are extremely thin compared with the thickness of the resonator elements and compared with the depth of the single cavity.

DETAILED DESCRIPTION OF PREFERRED EMBODIMENTS

Figure 4:
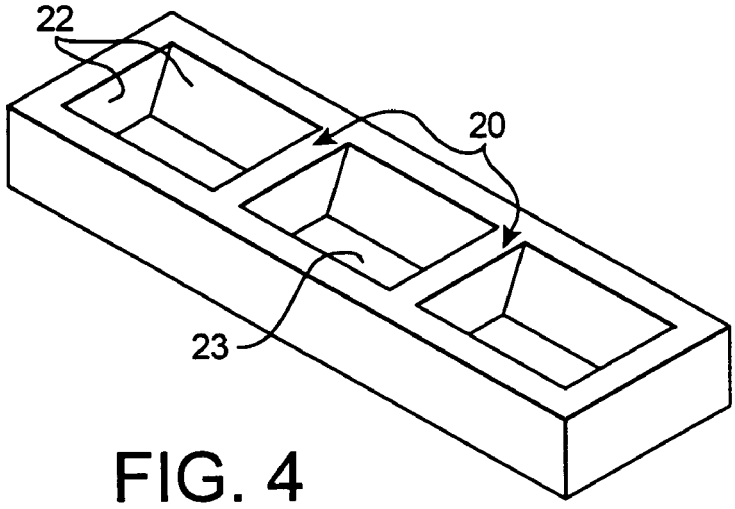

FIGS. 3 and 4 show an unclosed filter made according to the invention. This filter comprises a cavity 21 made in a substrate 200. The cavity comprises walls 22 and a bottom 23, and two resonator elements 20 are embedded in the width of the cavity at the placement areas. In FIG. 3, the cavity is made by plasma or laser etching: the walls 22 of the cavity 21 are at a right angle to the bottom 23 of the cavity. In FIG. 4 the cavity is made by wet etching, and its walls 22 are inclined from the bottom 23. In these two configurations, one of the dimensions (in this case the length) of the resonator elements 20 is identical to the width of the cavity; the resonator elements are embedded in the cavity and match the shape of the walls and the bottom of the cavity. The resonator elements 20 contribute to delimiting at least one wave guide area 24 and two extreme evanescent areas 25, in the cavity.

Figure 5:
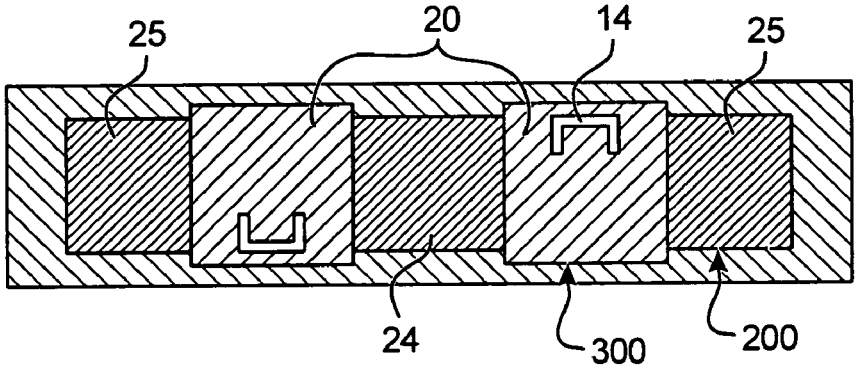
FIGS. 5 and 6 show a bottom view of two possible configurations of a filter structure according to the invention.

FIG. 5 shows a bottom view of a configuration of an unclosed filter, in other words before the shielding of the filter is closed by assembly on an adapted substrate. In this configuration, the placement areas in which the resonator elements 20 are inserted are wider than the width of the wave guide area 24 and the evanescent areas 25. The walls 22 of the cavity have protuberant parts 200 and setback parts 300, the setback parts 300 being used to house the resonator elements 20. Note that reference 14 represents a coupling window made in the metallisations of the resonator elements 20.

Figure 6:
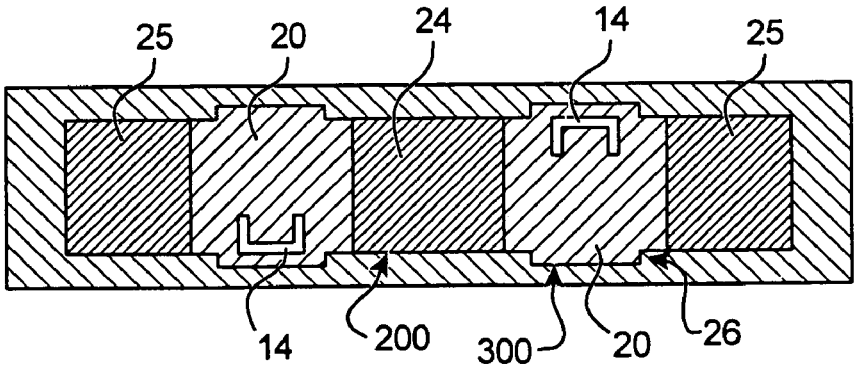

FIG. 6 shows a bottom view of another configuration of an unclosed filter according to the invention. In this case, the resonator elements 20 have not a rectangular or square shape, but have protuberant parts 26 such that the resonator elements are locally wider than the wave guide area 24 and the evanescent areas 25. In this case, the setback parts 300 in the walls 22 of the cavity and a portion of the protuberant parts 200 house the resonator elements 20. Many other configurations are possible. For example, the width of the placement areas in which the resonator elements are placed may be the same as the width of the wave guide area and wider than the evanescent areas. Note that when we refer to the "cavity" or the "single cavity", this space includes the wave guide area(s), the two evanescent areas and the placement areas.

Figure 7:
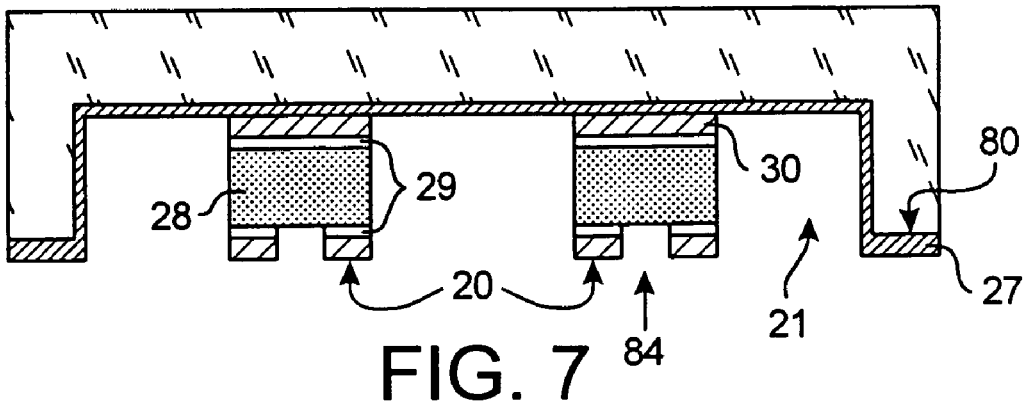
FIGS. 7 and 8 show a cross-sectional view of two configurations of an unclosed filter structure according to the invention.

FIG. 7 shows a cross-section through the filter. Two resonator elements 20 are placed in a cavity 21 made in a substrate at their placement area on a metallisation layer 27 deposited on the back face 80 of the substrate, on the walls and on the bottom of the cavity. This metallisation layer will be used as an electromagnetic shielding part of the filter. In this example, the resonator elements are made from silicon (reference 28), considered as a dielectric for high frequencies, sandwiched on two opposite faces by a layer of dielectric material 29 (in this case $SiO_2$) above which there is a metallisation layer 30. The metallisation layer 30 is brought into contact with the metallisation layer 27 of the cavity at its bottom. Reference 84 represents the coupling windows through which electromagnetic waves enter into and exit from the filter. In this case, the coupling windows 84 pass through the metallisation layer 30 and the layer of dielectric material 29, but the coupling windows would also operate if only the metallisation layer was open.

The shape and position of the coupling windows are not limitative. They are openings in the metallic shielding (and possibly the layer of dielectric material as shown in FIG. 7), preferably located at the resonator element. The coupling windows may be rectangular in shape, or they may be U-shaped.

Figure 8:
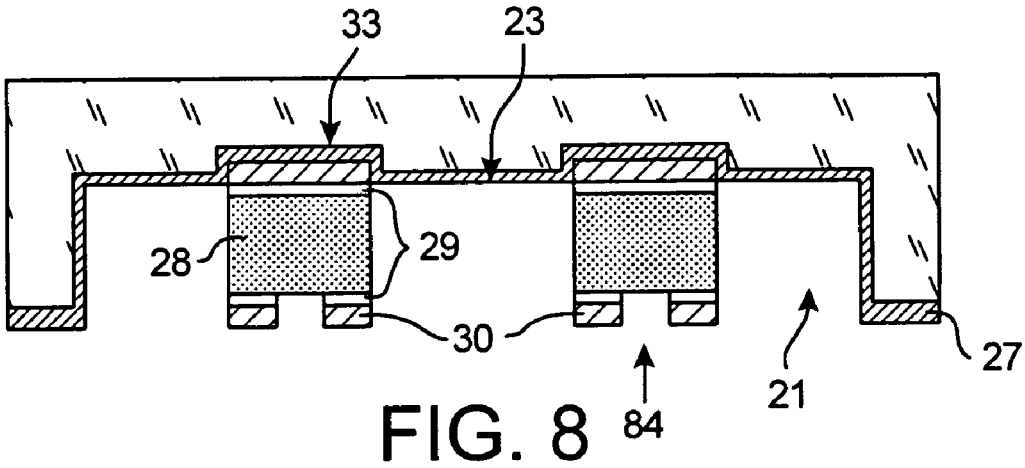

FIG. 8 shows the same configuration as FIG. 7, except that the bottom 33 of the cavity at the placement areas of the resonator elements is setback from the bottom 23 of the cavity at the evanescent areas and the wave guide area. The bottom of the cavity at the placement areas has been etched over a greater depth so as to adjust the metallisations 30 and 27; the metallisation layer 30 of the resonator elements is thus at the same level as the metallisation layer 27 placed on the bottom of the evanescent areas and the wave guide area.

Figure 9:
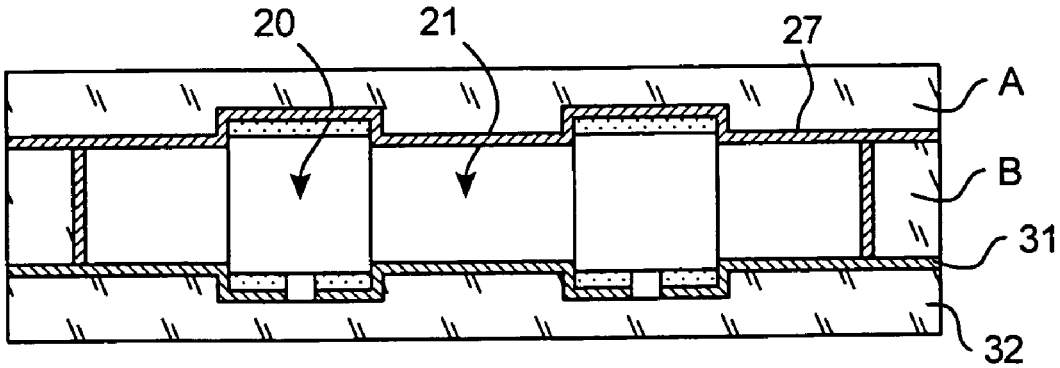
FIG. 9 shows a configuration of a filter with the structure of the filter being closed with a host substrate comprising a metallisation layer.

FIG. 9 shows a particular configuration in which the cavity 21 of the filter is closed using a metallisation layer 31 (in this case the metallisation layer 31 is deposited on a host substrate 32). Also in this example, the cavity is not obtained as in FIG. 8 by etching only in a substrate, but rather by the assembly of two substrates A and B. The size of the substrate B is designed to correspond to the depth of the cavity. In this case the electromagnetic shielding corresponds to metallisations of the two substrates A and B and the host substrate 32, the shielding thus forming the walls of the cavity.

The filter is manufactured in three separate parts; manufacture of a structure with a cavity, manufacture of resonator elements and assembly of the filter.

FIGS. 10*a* to 10*g* show steps in manufacturing a structure comprising a longitudinal cavity.

Figure 10A:
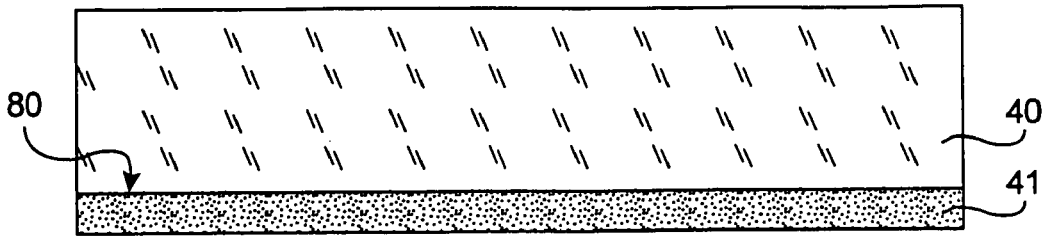
FIGS. 10*a* to 10*g* show the manufacturing steps for the single cavity of the filter.
Figure 10B:
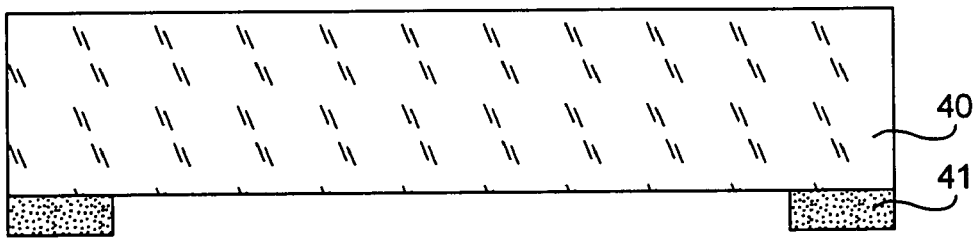

A layer of a photosensitive resin layer 41 is spread on one face 80 of a substrate 40 (for example made from silicon) (FIG. 10*a*).

This resin is then exposed through a mask and is developed (FIG. 10*b*) according to a particular pattern representing the shape of the cavity. For example, the pattern may be a simple rectangle, or its shape may be more complicated and be a rectangle with outgrowths at the placement areas. In the latter case, the width of the cavity will be greater at the placement areas than at the evanescent areas or the wave guide area.

Figure 10C:
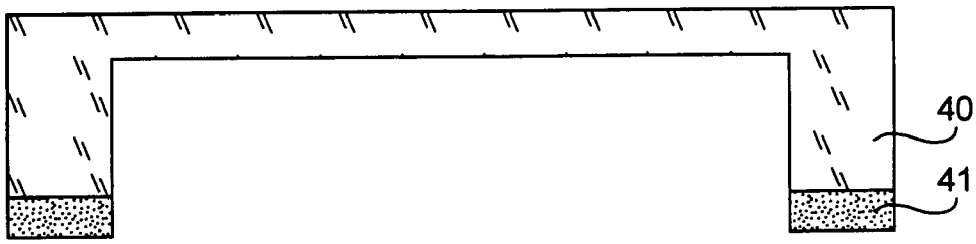

The substrate 40 is then etched, for example by plasma etching, down to the required depth (FIG. 10*c*). The depth may or may not be uniform.

Figure 10D:
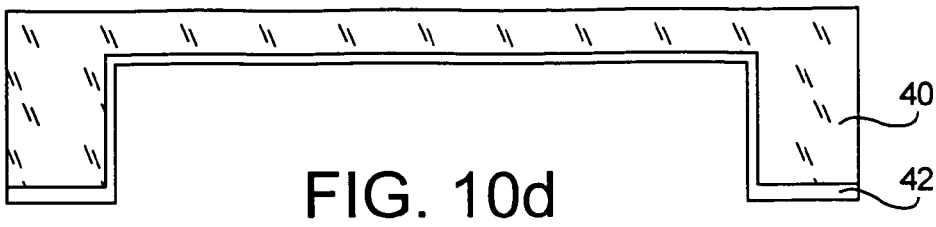

The photosensitive resin is then eliminated and a layer of dielectric material 42 (for example $SiO_2$) is deposited by PECVD (Plasma Enhanced Chemical Vapour Deposition) or by any other technique, onto the back face 80 of the structure, and on the bottom and the walls of the cavity (FIG. 10*d*). As a variant, a layer of polycrystalline silicon could be deposited before the $SiO_2$ to further improve the insulation between the metallic layer 43 to come and the substrate 40.

Figure 10E:
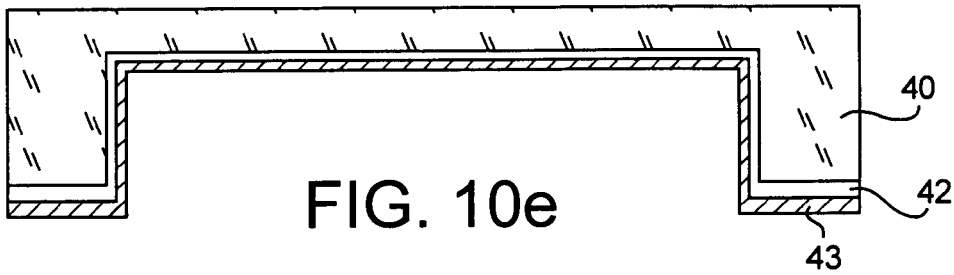

According to FIG. 10*e*, the next step is to deposit a metallisation layer 43 such as copper or multi-layers such as Ti/Cu or Ti/Au on the layer of dielectric material 42. For example, this deposit may be made by cathodic sputtering. Depending on the chosen assembly method, a layer or multi-layers can be deposited above the metallisation layer 43. For example, if it is required to assemble the filter by soldering, a three-layer deposit 44 can be deposited comprising a bond layer, a diffusion barrier layer and an oxidation protection layer, for example Ti/Ni/Au, on the metallisation layer 43.

Figure 10F:
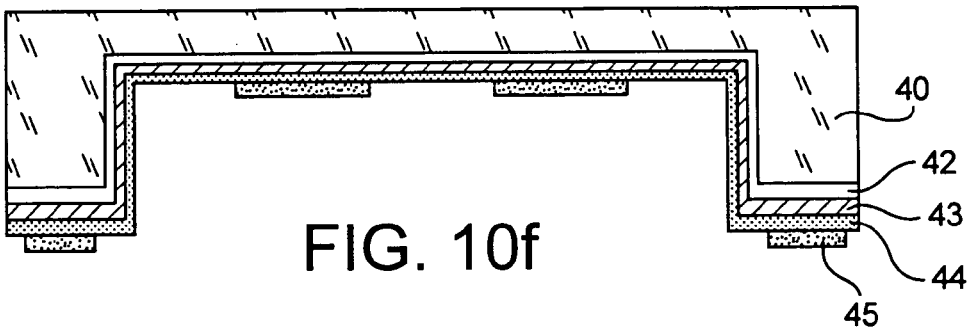
Figure 10G:
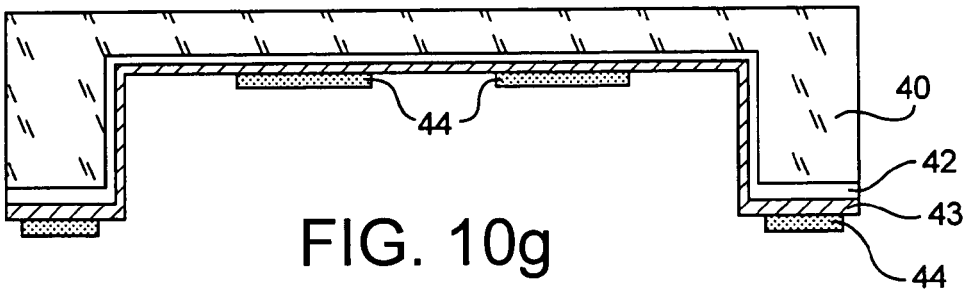

In this case, this three-layer deposit 44 is then delimited at the locations at which the solder is to be made. This is done by depositing a photosensitive resin 45 on this three-layer deposit, exposing it through a mask, and developing it (FIG. 10*f*). The next step is to etch the three-layer deposit 44 (FIG. 10*g*) and finally the photosensitive resin 45 is eliminated.

The next step is to make the resonator elements that will be inserted in the cavity placement areas. One example of manufacturing dielectric resonator elements is illustrated in FIGS. 11*a* to 11*f*.

Figure 11A:
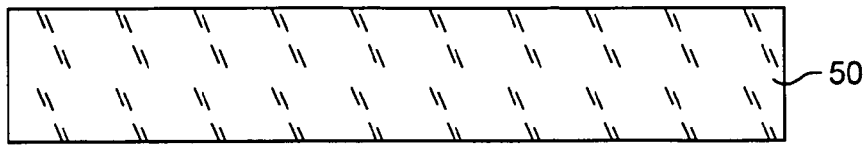
FIGS. 11*a* to 11*f* show the steps in manufacturing resonator elements according to the invention.
Figure 11B:
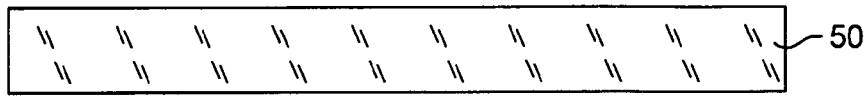

For example, a silicon substrate 50 may be used in this configuration (FIG. 11*a*). The substrate 50 (FIG. 11*b*) is thinned by grinding, by mechanical, mechanical-chemical polishing or by etching, to adjust the thickness of the future resonator element with the depth of the cavity at the placement area.

Figure 11C:
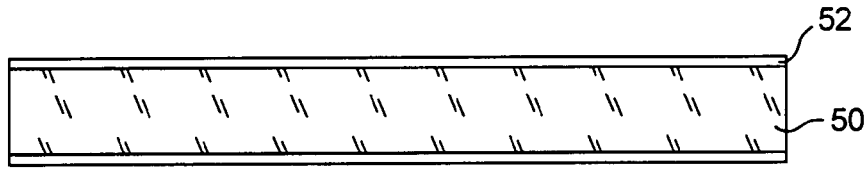
Figure 11D:
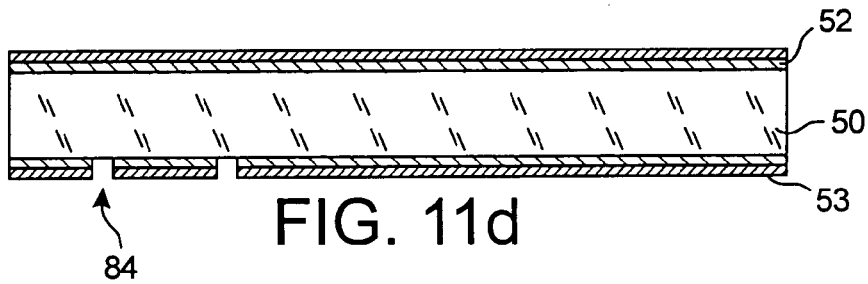

If the substrate 50 is made from silicon (considered as a dielectric for high frequencies), it is important to place a layer of complementary dielectric material 52 (such as $SiO_2$ or polysilicon) between this substrate and the metallic shielding to come. This material is deposited on the two opposite faces of the substrate 50 (FIG. 11*c*). This deposit is no longer necessary if the material from which the substrate 50 is made is a dielectric material with a higher performance, such as a ceramic like alumina. The next step is to deposit a metallisation layer 53 on the stack obtained, for example Ti/Cu or Ti/Au (FIG. 11*d*). This metallisation 53, that corresponds to the metallic shielding, is then locally opened (for example by photolithography and etching) to define the coupling windows 84. The remaining discontinuous layer 53 can then be used as a mask for removal of the subjacent dielectric, but this removal is not compulsory for operation of the filter.

In the figures illustrating the invention, the dielectric resonator elements shown are metallised on two opposite faces. The number of configurations for this invention can be increased by the number of metallised faces of resonator elements; no metallisation, one metallisation, two metallic planes or four metallic planes.

Figure 11E:
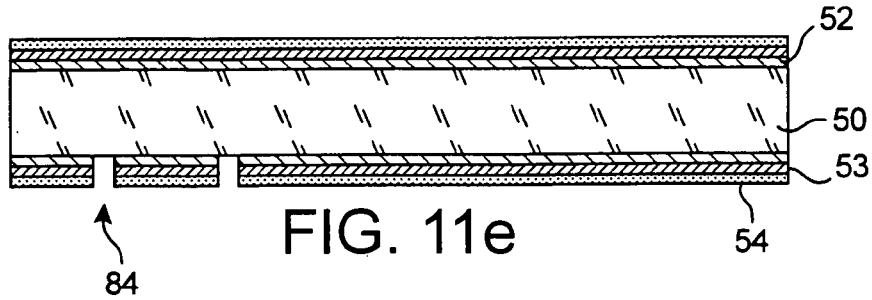

In the same way as for manufacturing the structure, one or several layers specific to the envisaged assembly type can be added onto the face(s) of the resonator elements that will come into contact with the bottom of the cavity at the placement areas or in contact with the metallisation layer closing the cavity. In this example, the filter was assembled by soldering. An appropriate three-layer deposit 54 (for example Ti/Ni/Au) is deposited on the metallisation layer 53 of the resonator elements (FIG. 11*e*). This three-layer deposit should be opened at the coupling windows (for example by photolithography and etching).

Figure 11F:
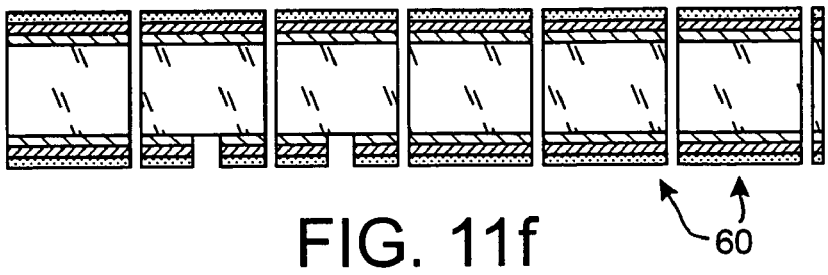

Finally, the last step in the formation of the resonator elements consists of separating them from each other, for example by cutting or by plasma etching (FIG. 11*f*). The resonator elements 60 may have different shapes. For example, they may be square or rectangular and inserted in placement areas with the same dimension (for example the width) as evanescent areas and the wave guide area. The resonator elements may also be inserted in placement areas for which the width is greater than the width of the wave guide and evanescent areas (see FIG. 5). In this case, the shape of the resonator elements may include protuberant parts as illustrated in FIG. 6.

Figure 12A:
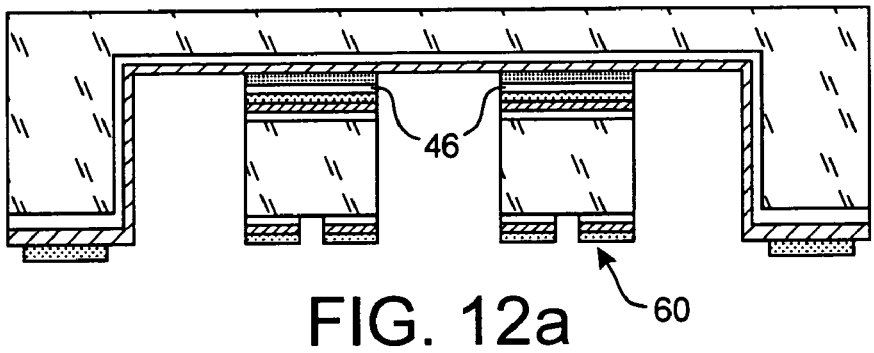
FIGS. 12*a* and 12*b* show the steps in a method of assembling the filter with a host substrate comprising a metallisation layer.
Figure 12B:
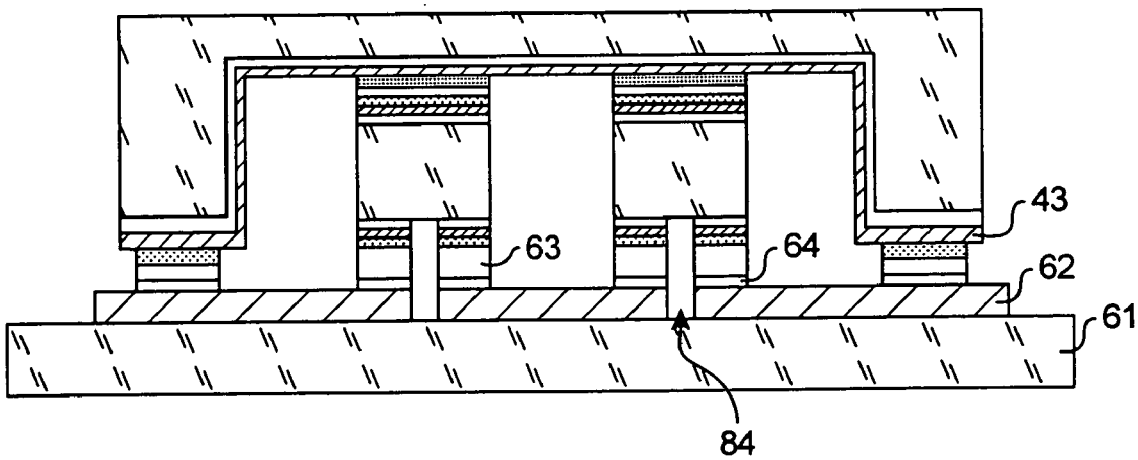

The last step in the formation of the filter according to the invention is assembly of the different constituents of the said filter. FIGS. 12*a* and 12*b* illustrate one assembly method of the filter.

The resonator elements are inserted into the cavity at their placement area. If the resonator elements comprise one or several metallised faces, care should be taken that the faces of the resonator elements opening up into the evanescent areas or into the area(s) of the wave guide are never metallised, since this would prevent coupling between the resonator elements.

In FIG. 12*a*, the resonator elements 60 are shown assembled by soldering (solder layer 46) on the bottom of the cavity. The solder may also be made on the walls of the cavity. Obviously, the resonator elements may be assembled inside the cavity by any technique other than soldering, for example thermal compression or gluing.

The filter, in other words the structure and its resonator elements, is then assembled to a host structure 61 comprising a metallisation layer 62 with openings corresponding to the coupling windows. The assembly may be made by soldering, gluing or thermal compression. In FIG. 12*b*, the assembly is obtained by soldering a fusible alloy 63 (for example Au/Sn alloy) onto a three-layer deposit 64 (for example Ti/Ni/Au). For good operation of the shielding, the electrical contact between the metallisation 43 of the filter and the metallisation 62 of the host substrate 61 is made around the periphery of the back face of the filter structure, obviously except on coupling windows through which the electromagnetic waves enter/exit.

For example, the steps in this process for making a filter according to the invention can be followed to make a 1.5 mm wide and 525 μm thick micro-machined filter that can be used for hyperfrequency applications, with 900 μm long resonator elements and that operates at a frequency of 42 GHz.

Note that although all the Figures mentioned in this description represent filters with two resonator elements, the invention could also be applied to filters with three or more resonator elements.

The invention has many advantages compared with prior art.

With the invention, filters for hyperfrequency applications can be made with a very good reproducibility. The use of plasma or laser etching can give better control over the dimensions of the cavity and consequently enable better reproducibility and guarantee filter performances. Furthermore, filters can be manufactured on a scale of a substrate wafer in which several filters are made at the same time and are then separated by cutting.

Furthermore, for a given cavity size, the manufacturing process can modify the characteristics of a filter by including different sized resonator elements in it. The dimensions of a resonator element determine the natural frequencies of the said resonator element.

The shielding step is also simplified compared with prior art. Since resonator elements are inserted in a cavity covered with a metallisation layer, there is no longer any obligation to metallise the front face of the filter. In this way, the step to metallise the edges surrounding the filter is eliminated.

Another advantage is due to the fact that a single large cavity is etched instead of several small cavities. This thus reduces etched areas and consequently the number of filters made per substrate wafer during manufacturing can be increased without increasing the fragility of the wafer used.

The invention provides another advantage related to the layers of dielectric material. In prior art, a layer of dielectric material 11 has to be deposited between the metallisation layer 5 and the substrate 100 for insulation (see FIG. 1). This layer thus acts partly to obtain the required performances for the hyperfrequency application, and as a mask for wet etching. But dielectric materials adapted for hyperfrequencies (in other words with low dielectric losses) are not necessarily suitable for wet etching. This invention separates these two roles. A first masking material adapted for wet etching can be deposited and then removed after the etching step, and a higher performance dielectric material can then be deposited for hyperfrequency applications.

An additional advantage of this invention is that materials with a high permittivity and low dielectric losses can be chosen for the resonator elements, for example silicon, alumina, quartz or any other material. This can make it possible to use a higher performance material than silicon or to choose a material adapted to the wavelength. For example, silicon is not longer a good material for frequencies below 10 GHz.

Another advantage is that the different components of the filter can be assembled removably (for example simply by embedding) before final assembly, so as to test the performances of the filter and if necessary to change the resonator elements if necessary, if their sizes are badly adapted.

The invention claimed is:

1. A frequency filter, comprising:

a structure that includes a single cavity having a bottom and walls, and at least two resonator elements embedded at placement areas in the single cavity, wherein the at least two resonator elements partition off the single cavity into closed areas forming, on one face of the structure, two evanescent areas, and at least one wave guide area, the at least one wave guide area being located between the two evanescent areas; and at least one wall or the bottom of the single cavity has at least one protuberant part and at least one setback part, said at least one protuberant part and said at least one setback part forming a relief configured to aid in embedding the at least two resonator elements in the placement areas of the single cavity.

2. A frequency filter according to claim 1, wherein the structure is made from a material with low dielectric losses.

3. A frequency filter according to claim 1, wherein the at least two resonator elements are made from a material with high permittivity and low dielectric losses.

4. A frequency filter according to claim 3, wherein the at least two resonator elements are made from silicon or ceramic.

5. A frequency filter according to claim 1, wherein at least two of the at least two resonator elements are made from an identical material and have identical dimensions.

6. A frequency filter according to claim 1, further comprising an electromagnetic shielding, said shielding comprising:

a first metallisation layer covering the bottom and the walls of the single cavity and the face of the structure containing the single cavity, a second metallisation layer closing the single cavity and being in electrical contact with the first metallisation layer and with the at least two resonator elements.

7. A frequency filter according to claim 6, wherein the second metallisation layer is deposited on a host substrate with low dielectric losses.

8. A frequency filter according to claim 6, wherein the shielding comprises at least two openings that form coupling windows.

9. A frequency filter according to claim 8, wherein these openings are made at the at least two resonator elements.

10. A process for manufacturing at least one frequency filter according to claim 1, said manufacturing process comprising the following steps:

forming a structure comprising the single cavity on a back face of the structure, embedding the at least two resonator elements in the single cavity at placement areas so as to delimit the at least one wave guide area and the evanescent areas.

11. A process for manufacturing at least one frequency filter according to claim 10, further comprising:

metallizing the back face of the structure, the walls and the bottom of the single cavity before the of the at least two resonator elements, and closing the single cavity using a metallisation layer after the embedding.

12. A process for manufacturing at least one frequency filter according to claim 11, wherein the metallisation layer used to close the single cavity comprises at least two openings.

13. A process for manufacturing a filter according to claim 10, wherein the of the structure comprises the following steps:

supplying a first substrate, and etching at least the single cavity in the first substrate.

14. A process for manufacturing a filter according to claim 13, wherein the first substrate is made from a material with low dielectric losses.

15. A process for manufacturing a filter according to claim 14, wherein the first substrate is made from a material chosen among silicon or quartz.

16. A process for manufacturing a filter according to claim 13, wherein the etching is a plasma etching, the plasma etching comprising:

depositing a layer of photosensitive resin on the back face of the first substrate, exposing the photosensitive resin through a mask, developing said photosensitive resin, etching the first substrate, eliminating the photosensitive resin, and depositing a layer of dielectric material on the back face of the first substrate.

17. A process for manufacturing a filter according to claim 16, wherein the mask used includes a pattern configured to obtain the single cavity with at least one protuberant part and at least one setback part in at least one wall or the bottom of the single cavity.

18. A process for manufacturing a filter according to claim 16, wherein the dielectric material is polycrystalline silicon, silica, an organic dielectric or multiple layers of different dielectric materials.

19. A process for manufacturing a filter according to claim 10, further comprising manufacturing the at least two resonator elements, the manufacturing the at least two resonator elements comprising:

supplying a second substrate, and separating the at least two resonator elements by cutting or by etching of the said second substrate.

20. A process for manufacturing a filter according to claim 19, further comprising a step to adjust the height of the said second substrate after the step to supply the second substrate.

21. A process for manufacturing a filter according to claim 19, wherein the second substrate is made from a material chosen from among silicon, alumina or quartz.

22. A process for manufacturing a filter according to claim 19, wherein the manufacturing the at least two resonator elements includes depositing a layer of a dielectric material on a face of the second substrate, two opposite faces of the second substrate or four opposite faces of the second substrate.

23. A process for manufacturing a filter according to claim 22, wherein the manufacturing the at least two resonator elements includes depositing a metallisation layer on any face of the second substrate comprising a layer of dielectric material.

24. A frequency filter according to claim 1, wherein at least one wall and the bottom of the single cavity have at least one protuberant part and at least one setback part, said at least one protuberant part and at least one setback part forming a relief configured to aid in embedding the at least two resonator elements in the single cavity at their placement area.

* * * * *